US006643483B1

(12) United States Patent
Hirabayashi

(10) Patent No.: US 6,643,483 B1
(45) Date of Patent: Nov. 4, 2003

(54) FIXING APPARATUS FOR FIXING TONER IMAGES ON RECORDING MEDIA AND IMAGE FORMING APPARATUS COMPRISING THE FIXING APPARATUS

(75) Inventor: Masao Hirabayashi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/202,832

(22) Filed: Jul. 26, 2002

(51) Int. Cl.[7] ..... G03G 15/20
(52) U.S. Cl. ..... 399/124; 399/122
(58) Field of Search ..... 399/124, 121, 399/122, 320, 328, 67, 400, 21, 110, 107, 125, 18, 22; 271/278, 306; 292/251, 256.71, 256.73; 411/402, 544, 919, 371.2, 372.5

(56) References Cited

U.S. PATENT DOCUMENTS 5,839,032 A * 11/1998 Yasui et al. ..... 399/124
5,991,572 A * 11/1999 Cho ..... 399/124
6,428,061 B1 * 8/2002 Daoud ..... 292/251

FOREIGN PATENT DOCUMENTS

JP 05173440 A * 7/1993 ..... G03G/15/20
JP 8-123293 5/1996
JP 8-314217 11/1996

* cited by examiner

*Primary Examiner*—Hoan Tran
(74) *Attorney, Agent, or Firm*—Foley & Lardner

(57) ABSTRACT

A fixing apparatus includes a case which surrounds a fixing device and has an opening portion, a cover provided on the case so as to open and close the opening portion, a cover-fixing shaft which is provided on the cover so as to be detachable to the case, a knob which is movably provided on the cover-fixing shaft, an elastic member which is provided on the cover-fixing shaft and applies force to the knob in a direction away from the cover, and a stopper which prevents movement of the knob against force of the elastic member.

12 Claims, 4 Drawing Sheets

FIXING APPARATUS FOR FIXING TONER IMAGES ON RECORDING MEDIA AND IMAGE FORMING APPARATUS COMPRISING THE FIXING APPARATUS

BACKGROUND OF THE INVENTION

The present invention relates to a fixing apparatus for fixing toner images on recording media and image forming apparatus comprising the fixing apparatus.

Image forming apparatuses adopting electrophotography comprise a fixing apparatus which fixes toner images formed on recording media. Such fixing apparatuses include those adopting a heating and pressing method. Fixing apparatuses adopting this method each comprise a heating roller and a pressure roller, carry recording media between the both rollers by rotating the rollers, and heat and press toner images to fix them on the recording media.

In the fixing apparatus, sometimes the situation in which recording media are not conveyed but stopped and jammed (paper jam) occurs, which hinders a fixing operation. For example, there are cases where a recording medium is curved by heat of the heating roller, collides with parts provided in the vicinity of the heating roller, and stops.

Therefore, image forming apparatuses are each provided with an opening portion and a cover for opening/closing the opening portion at a case surrounding the rollers, such that jammed recording media can be removed. Normally, the cover closes the opening portion to prevent the operator from touching the rollers by hand. When paper jam occurs, the operator can open the cover and insert the hands into the case through the opening portion to take out the jammed recording media.

When the cover is unstable to the case at the position where the opening portion is closed, a problem occurs that the cover vibrates and causes noise. It is thus necessary to secure the cover to the case.

Therefore, in the conventional art, the cover is secured to the case by using screws in the state where the cover is closed. Specifically, tapped holes are formed at the case, and plain holes are formed at the cover. Screws are screwed into the tapped holes of the case from the outside of the cover through the plain holes of the cover.

In the structure, when the cover is to be secured to the case, by using tools, an operation is performed to insert screws into the tapped holes of the case through the plain holes of the cover, and engage them into the tapped holes by turning the screws in the direction of tightening them. When the cover is released from fixation to the case, an operation is performed to extract the screws from the tapped holes of the case and the plain holes of the cover by turning the screws in the direction of loosening them by using tools.

As described above, when the cover is fixed to the case or released from the fixation, it is necessary to turn the screws by using tools. Specifically, when the cover is fixed to the case and the cover is released from the fixation, required are an operation to carry a tool to the part in which the cover is provided, an operation to engage the tool with each screw to turn them, and an operation to carry the tool from the part in which the cover is provided.

Therefore, when recording media are jammed in the fixing apparatus, much labor and time are required for the process to open the cover and extract the jammed recording media from the inside of the case.

BRIEF SUMMARY OF THE INVENTION

The present invention is to provide a fixing apparatus, which has an improved structure of fixing an openable/closable cover provided at a case surrounding a fixing device, and enables an easy and prompt processing in the case where recording media have been jammed.

The present invention is to provide an image forming apparatus comprising the fixing apparatus.

A fixing apparatus according to an embodiment of the present invention comprises: a fixing device which fixes an unfixed toner image formed on the recording medium while conveying a recording medium; a case which surrounds the fixing device and has an opening portion;

a cover provided on the case so as to open and close the opening portion of the case; a cover-fixing shaft which is provided on the cover so as to be detachable to the case, a part of the cover-fixing shaft projecting outside the cover; a knob which is provided on the cover-fixing shaft to be movable along its axial direction and projects to the outside of the cover-fixing shaft by movement; an elastic member which is provided on the cover-fixing shaft and applies force to the knob in a direction away from the cover; and a stopper which prevents movement of the knob against force of the elastic member.

An image forming apparatus according to an embodiment of the present invention comprises: an apparatus main body having an open portion; a door which is provided on the apparatus main body to open and close the open portion; a photosensitive member which is provided inside the apparatus main body to form a toner image; a transfer member which is provided inside the apparatus main body to transfer the toner image of the photosensitive member onto a recording medium; and a fixing apparatus which is provided inside the apparatus main body, facing the open portion, and fixes the toner image transferred onto the recording medium, the fixing apparatus further comprising: a fixing device which fixes a toner image formed on the recording medium while conveying a recording medium; a case which surrounds the fixing device and has an opening portion; a cover provided on the case so as to open and close the opening portion of the case; a cover-fixing shaft which is provided on the cover so as to be detachable to the case, a part of the cover-fixing shaft projecting outside the cover; a knob which is provided on the cover-fixing shaft to be movable along its axial direction and projects to the outside of the cover-fixing shaft by movement of the shaft; an elastic member which is provided on the cover-fixing shaft and applies force to the knob in a direction away from the cover; and a stopper which prevents movement of the knob against force of the elastic member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be explained with reference to the drawings.

Figure 1:
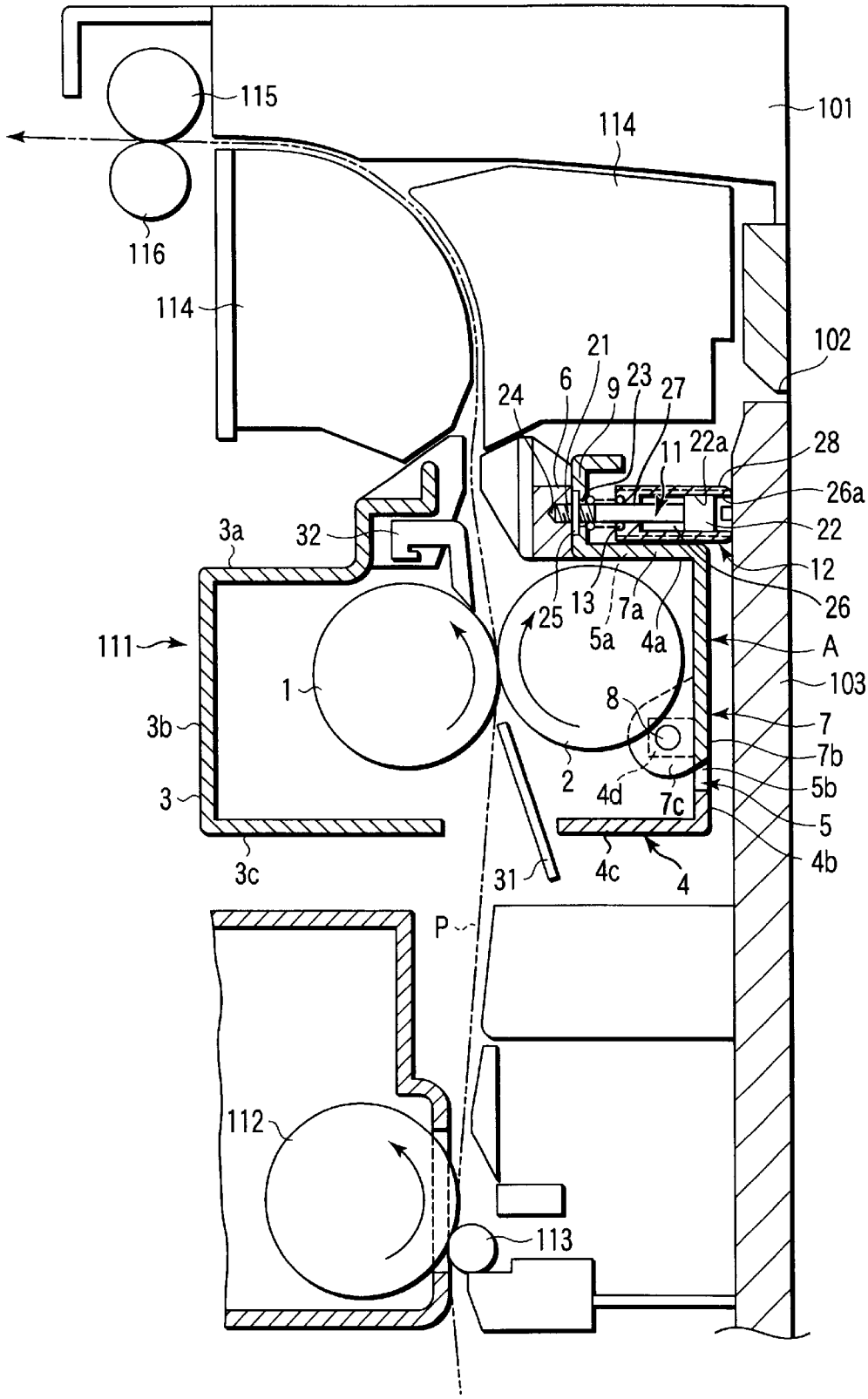
FIG. 1 is a cross-sectional view schematically showing an image forming apparatus comprising a fixing apparatus related to an embodiment of the present invention.

FIG. 1 is a cross-sectional view schematically showing an image forming apparatus comprising a fixing apparatus related to an embodiment of the present invention. An image forming apparatus of the embodiment conveys recording media from its lower portion to its upper portion along a vertical direction, and forms images on the recording media during the conveying process. Recording paper is used as recording media in the embodiment.

A fixing apparatus 111 which is a subject of the present invention is provided inside an apparatus main body 101 of the image forming apparatus, and a photosensitive drum 112 and a transfer roller 113 are provided under the fixing apparatus 111. The photosensitive drum 112 is rotated around its axis, and a toner image is formed thereon by electrophotography. The transfer roller 113 is rotated around its axis, and transfers the toner image on the photosensitive drum 112 onto recording medium P while conveying the recording medium P upward in cooperation with the photosensitive drum 112. The fixing apparatus 111 fixes the toner image transferred onto the recording medium P on the recording medium P.

A guide 114 is provided above the fixing apparatus 111. The guide 114 guides the recording medium P which has passed the fixing apparatus 111 upward. A pair of ejection rollers 115 and 116 is provided above the guide 114. The pair of ejection rollers 115 and 116 is rotated around respective axes, and ejects the recording medium P outside the apparatus main body 101 in cooperation with each other.

An open portion 102 facing the photosensitive drum 112 and the fixing apparatus 111 is formed at a vertical wall portion of the apparatus main body 101, and a door 103 which opens and closes the open portion 102 is provided on the apparatus main body 101. The open portion 102 is used for an operation of taking out recording medium P from the fixing apparatus 111 when the recording medium P is jammed in the fixing apparatus 111. The door 103 for opening and closing the open portion 102, for example, is supported at lower end portion by a horizontal fulcrum shaft such that it is swung along a direction of opening and closing the open portion 102.

Figure 2:
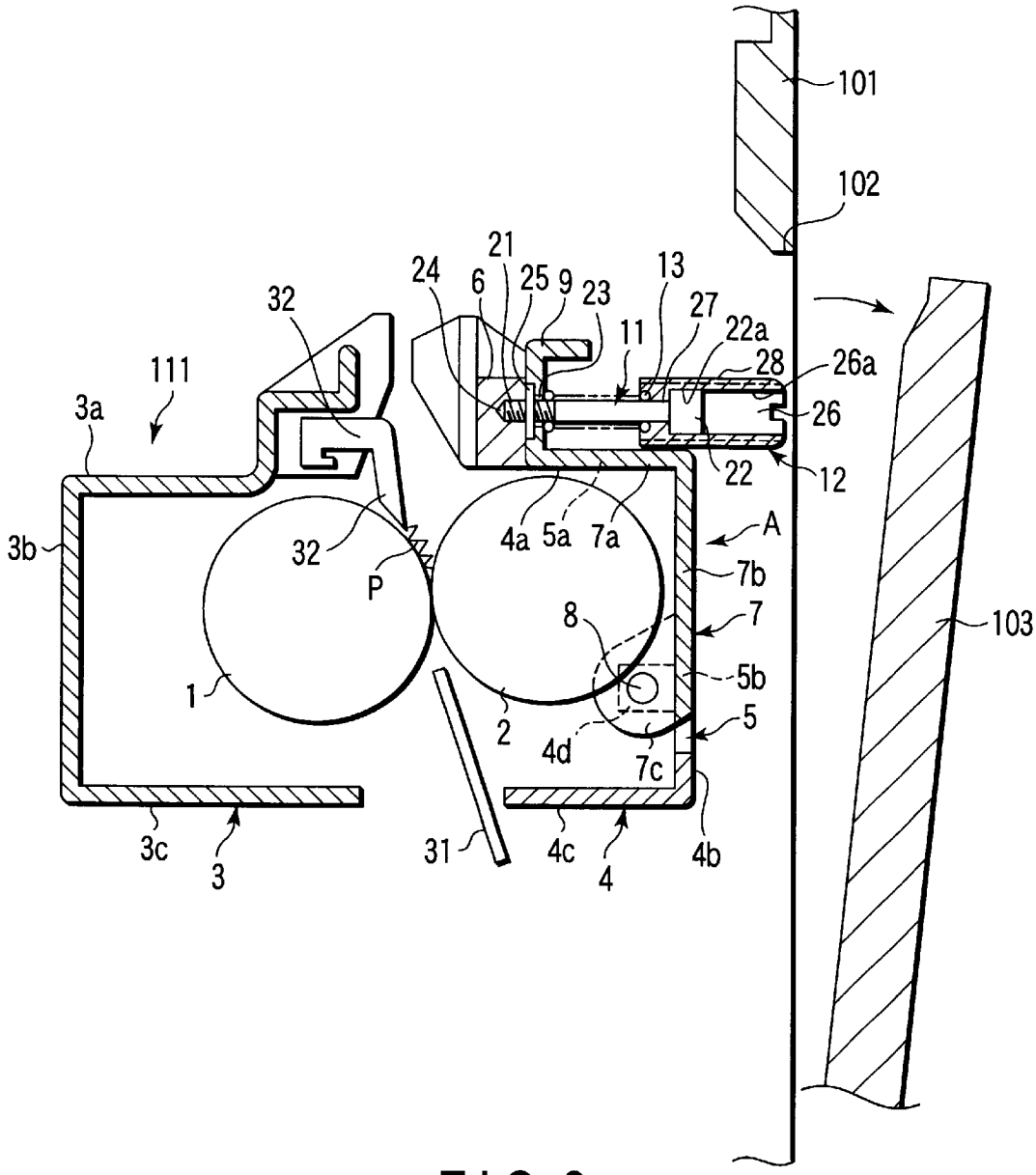
FIG. 2 is a cross-sectional view showing the fixing apparatus related to the embodiment.
Figure 3:
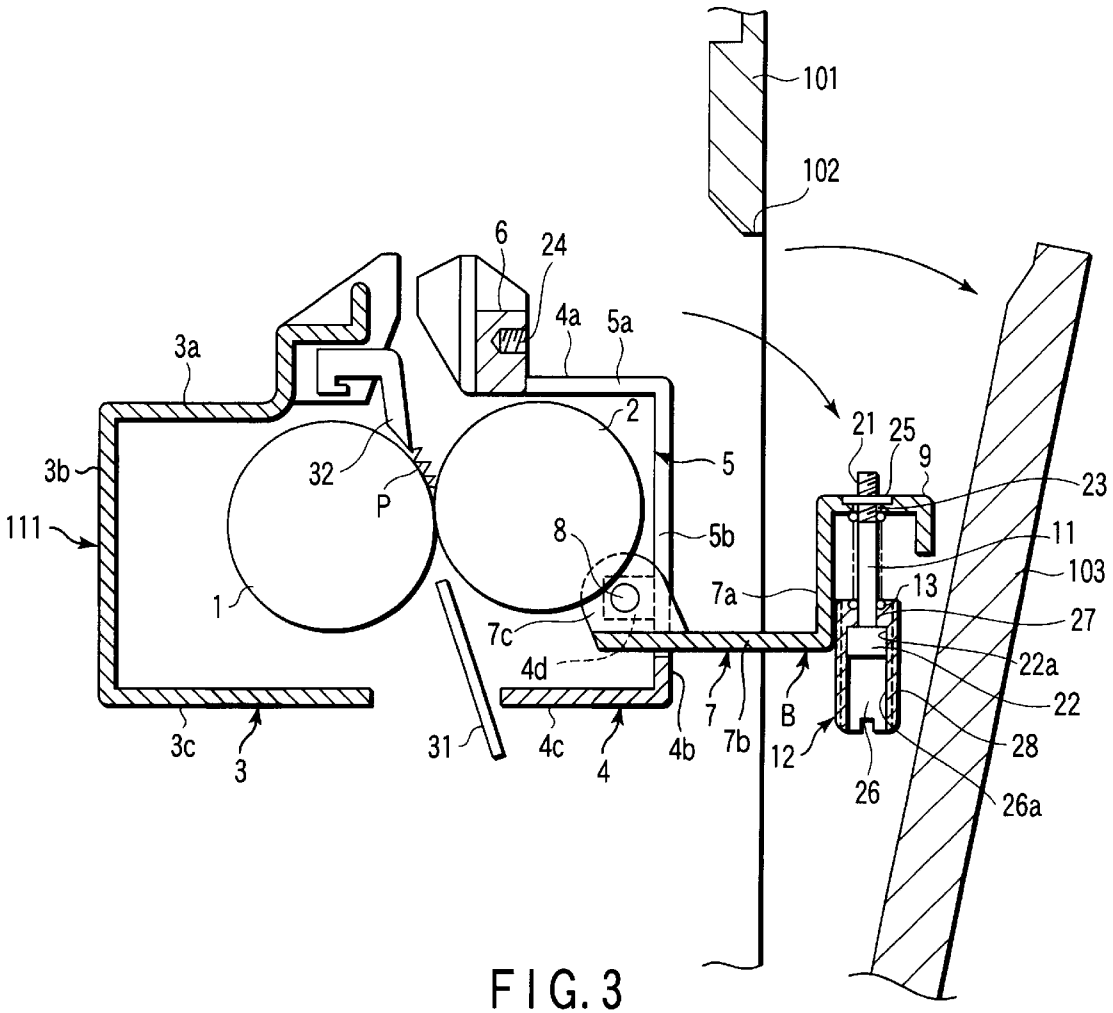
FIG. 3 is a cross-sectional view showing the fixing apparatus related to the embodiment.

Next, the fixing apparatus 111 will now be explained. FIG. 1 shows a state where the fixing apparatus 111 is performing fixing. FIGS. 2 and 3 show an operation of taking out a jammed recording medium P from the fixing apparatus 111.

The fixing apparatus 111 adopts a heating and pressing method, and includes a heating roller 1 and a pressure roller 2 as fixing devices. The heating roller 1 is horizontally provided, and rotated around its axis by a drive (not shown). The heating roller 1 has a heater (not shown) inside, and is heated by the heater. The pressure roller 2 is horizontally provided at a position close to the open portion of the apparatus main body 101 so as to face the heating roller 1, and touches the heating roller 1 by being pushed by an elastic member (not shown). The pressure roller 2 is rotated by drive of the heating roller 1.

A case 3 and a case 4 surround the heating roller 1 and the pressure roller 2. The case 3 surrounds the heating roller 1, and is disposed outside the heating roller 1 along the axial direction of the heating roller. The case 3 has a horizontal upper surface portion 3*a*, a vertical side surface portion 3*b*, and a horizontal lower surface portion 3*c*, and a side facing the pressure roller 2 (the side facing the case 4) is opened. The case 3 holds the heating roller 1 and the heater.

The case 4 surrounds the pressure roller 2, and is disposed outside the pressure roller 2 along the axial direction of the pressure roller 2. The case 4 has a horizontal upper surface portion 4*a*, a vertical side surface portion 4*b*, and a horizontal lower surface portion 4*c*, and a side facing the heating roller 1 (the side facing the case 3) is opened. The case 4 holds the pressure roller 2.

As described above, the case 3 is horizontally disposed at a position distant from the open portion 102 of the apparatus main body 101 with respect to the heating roller 1, and the case 4 is horizontally disposed at a position close to the open portion 102 with respect to the heating roller 1. The case 3 and case 4 are assembled by members (not shown) and held in the apparatus main body 101.

An opening portion 5 is formed at the case 4 along the axial direction. The opening portion 5 has an upper portion 5*a* located on the upper surface portion 4*a* of the case 4, and a side portion 5*b* located on the side surface portion 4*b* facing the open portion 102 of the apparatus main body 101, and the portions adjoin each other at right angles. The opening portion 5 is used for taking out a recording medium P jammed inside the cases 3 and 4, and the contact portion of the heating roller 1 and the pressure roller 2 can be accessed from the opening portion 5.

A receiver 6 is formed on an edge portion of an open portion of the upper surface portion 4*a* of the case 4 along the axial direction of the case 4 (the axial direction of the pressure roller 2). The receiver 6 is formed to stand upward.

A cover 7 is provided on the case 4. The cover 7 opens and closes the opening portion 5 of the case 4. The cover 7 has a length corresponding to the axial length of the opening portion 5, and has a form in which an upper surface portion 7*a* covering the upper portion 5*a* of the opening portion 5 and a side surface portion 7*b* covering the side portion 5*b* of the opening portion 5 adjoin each other at right angles. An arm portion 7*c* is formed on each of both ends of the cover 7, and an arm portion 4*d* is formed on each of both ends of the case 4 to be opposed to arm portions 7*c*.

A fulcrum shaft 8 is horizontally inserted, along the case axis direction, through each pair of the arm portions 4*d* and arm portions 7*c* opposing on one end and the other end of the case 4 and the cover 7. The cover 7 is rotatably held by the case 4 with the fulcrum shaft 8 serving as a fulcrum, and thus is movable between position A shown in FIG. 1, where the opening portion 5 is closed, and position B shown in FIG. 3, where the opening portion 5 is opened.

An abutting member 9 is formed, along the axial direction of the cover 7 (the axial direction of the pressure roller 2), on the edge portion of the open portion of the upper surface portion 7*a* of the cover 7. The abutting member 9 is formed to stand upward. The abutting member 9 abuts against the receiver 6 of the case 4 when the cover 7 is located at the position A where it closes the opening portion 5 of the case 4, and keeps the cover 7 at the position A.

This embodiment has a cover-fixing shaft 11, a knob 12, and a compression coiled spring 13, as members for fixing the cover 7 onto the case 4. These parts are assembled into a unit, and provided in the abutting member 9 of the cover 7, for example, an axial middle portion of the abutting member 9.

Figure 5:
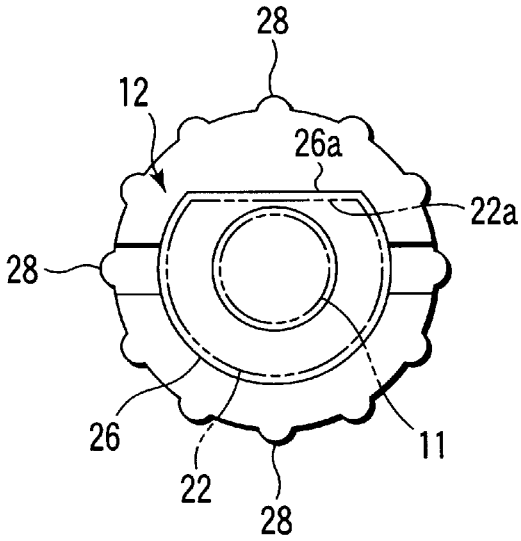
FIG. 5 is a side view showing the knob used in the fixing apparatus related to the embodiment.

The cover-fixing shaft 11 is formed of a round rod, in which a screw portion 21 is formed on the distal end portion (an end portion closer to the receiver 6) and a head portion 22 is formed on the proximal end portion (the other end portion). As shown in FIG. 5, the head portion 22 has a circular shape having a diameter greater than the diameter of the cover-fixing shaft 11, and a cut-off portion 22*a* is formed, which is made by cutting off a part of the outer peripheral surface along its diameter direction. The cover-fixing shaft 11 is made of metal.

A hole 23 is formed, along the opening/closing direction of the cover (the thickness direction of the receiver), at the axial middle direction of the abutting member 9 of the cover 7. A tapped hole 24 is formed, along the opening/closing direction of the cover (the thickness direction of the receiver), at the axial central direction of the receiver 6 of the case 4. The hole 23 and the tapped hole 24 are aligned on the same horizontal axis when the cover 7 is in the closing position A.

The cover-fixing shaft 11 is disposed above the upper surface portion 7*a* of the cover 7 in parallel with the upper surface portion 7*a*. The cover-fixing shaft 11 is movably inserted through the hole 23 of the cover 7. A retaining ring 25 is attached to the root portion of the screw portion 21 of the cover-fixing shaft 11. The retaining ring 25 is abutted on a surface of the abutting member 9 (a surface facing the receiver 6), and thereby prevents the screw portion 21 of the cover-fixing shaft 11 from falling out from the hole 23 toward the upper surface portion 7*a* of the cover 7. Therefore, the screw portion 21 of the cover-fixing shaft 11 is disposed opposite to the upper surface portion 7*a* of the cover 7 with respect to the abutting member 9, and it is possible to screw the screw portion 21 of the cover-fixing shaft 11 into the tapped hole 24 of the receiver 6 when the cover 7 is located at closing position A. The part of the cover-fixing shaft 11 other than the screw portion 21 is located at a position corresponding to the upper surface portion 7*a* of the cover 7. portion 22.

Figure 4:
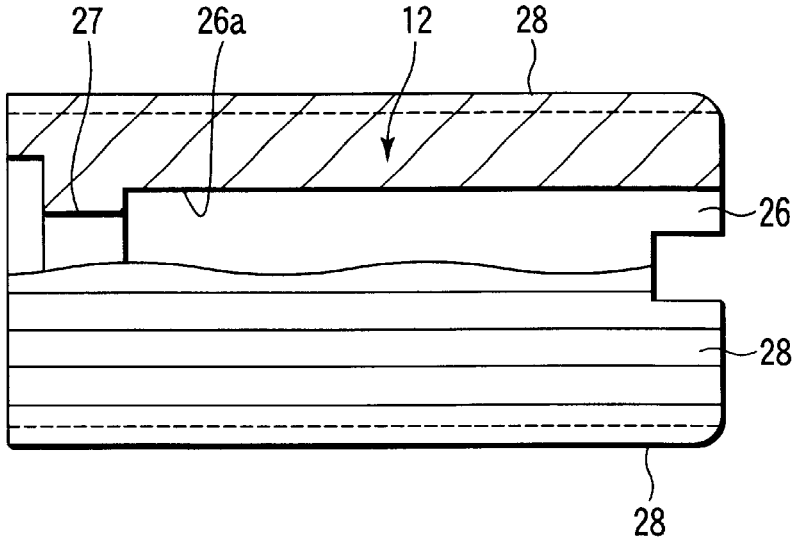
FIG. 4 is a front view, partially cutaway, showing a knob used in the fixing apparatus related to the embodiment.

As shown in FIGS. 4 and 5, the knob 12 is a cylinder having an internal hole 26. The distal end portion (an end portion closer to the abutting member 9) of the knob 12 is closed, and the proximal end portion is opened. A shaft hole 27 is formed to pierce through the distal end portion of the knob 12. The shaft hole 27 has a diameter smaller than that of the internal hole 26, and the cover-fixing shaft 11 is movably inserted through the shaft hole 27. A flat portion 26*a* is formed in a part of the peripheral surface of the internal hole 26 so as to extend along the whole axial direction. The internal hole 26 is fit with the head portion 22 of the cover-fixing shaft 11, and has a diameter of the same size as that of the head portion 22. The flat portion 26*a* of the internal hole 26 catches the cut-off portion 22*a* of the head As an additional explanation, the distal end portion of the cover-fixing shaft 11 is inserted from the proximal end portion of the knob 12 into the internal hole 26 through the shaft hole 27, to insert the head portion 22 into the internal hole 26. Thereby, the head portion 22 of the cover-fixing shaft 11 prevents the knob 12 from rotating around the axis, and the knob 12 is movably held along the axial direction. When the knob 12 moves to the head portion 22 of the cover-fixing shaft 11, the distal end narrowing portion of the knob abuts against the head portion 22, which prevents the knob from falling out from the cover-fixing shaft 11. At this state, the proximal end portion of the knob 12 projects outside from the head portion 22 of the cover-fixing shaft 11.

The knob 12 is formed of a material of a low thermal conductivity, for example, a synthetic resin having a low thermal conductivity. The knob 12 has a knurled portion on its outside surface. For example, on the external peripheral portion of the knob 12, a plurality of strip bumps 28 along the axial direction are formed to be arranged with intervals in the circumferential direction.

The compression coiled spring 13 is an example of an elastic member that is provided on the cover-fixing shaft 11 and applies force to the knob 12 in a direction away from the cover 7. The compression coiled spring 13 is provided on the cover-fixing shaft 11. The compression coiled spring 13 is placed between the abutting member 9 of the cover 7 and the distal end portion of the knob 12. One end of the compression coiled spring 13 is abutted against the abutting member 9 of the cover 7, and the other end is abutted against the distal end of the knob 12. The compression coiled spring 13 always applies force to the knob 12 toward the head portion 22 of the cover-fixing shaft 11.

A guide 31 is provided beneath a contact portion of the heating roller 1 and the pressure roller 2, and a guide 32 is provided above the contact portion.

A fixing operation in the fixing apparatus 111 structured as described above is as follows. A recording medium P on which a toner image has been formed is guided by the guide 31 and passes through the contact portion between the heating roller 1 and the pressure roller 2, and then guided by the guide 32 and conveyed. During this step, the toner image is fixed on the recording media P by heating and pressing.

An operation of closing and opening the opening portion 5 of the case 4 by the cover 7 in the fixing apparatus 111 will be explained.

When the cover 7 closes the opening portion 5 of the case 4, as shown in FIG. 1, the cover 7 is located at the position A where the cover 7 closes the opening portion 5 of the case 4. The abutting member 9 of the case 4 abuts against the receiver 6 of the case 3, and the cover 7 is kept at the position A for closing the opening portion 5. The upper surface portion 7*a* of the cover 7 closes the upper portion 5*a* of the opening portion 5, and the side surface portion 7*b* closes the side portion 5*b* of the opening portion 5. The screw portion 21 of the cover-fixing shaft 11 is screwed into the tapped hole 24 of the receiver 6 of the case 4 by rotating in a tightening direction. The position of screwing the cover-fixing shaft 11 is limited by the retaining ring 25 abutting against the receiver 6. Thereby, the cover 7 is fixed on the case 4 at the closing position A.

In the embodiment, a door 103 serves as a stopper which prevents movement of the knob 12 against force of the compression coiled spring 13 being an elastic member. By using the door 103 provided on the apparatus main body 101 as a stopper, there is no need to provide a special member, and the structure and operation of the apparatus are simplified.

The door 103 of the apparatus main body 101 is located at a position of closing the open portion 102, and fixed on the apparatus main body 101 by a member (not shown). When the door 103 is located at a position of closing the open portion 102, a gap exists between the door and the side surface portion 7*b* of the cover 7 at the closing position A, and thus the door 103 does not collide with the fixing apparatus 111. The knob 12 is pushed by the compression coiled spring 13 toward the proximal end portion of the cover-fixing shaft 11 (toward the door 103), and its proximal end abuts against the door 103. In other words, the knob 12 is pushed by the door 103 located at the position of closing the open portion 102 of the apparatus main body 101, and presses the compression coiled spring 13 by moving toward the distal end of the cover-fixing shaft 11.

In this state, the knob 12 is positioned where the most part of the knob overlaps the upper surface portion 7*a* of the cover 7, and only the proximal end of the knob projects into the gap between the door 103 and the side surface portion 7*b* of the cover 7. Therefore, when the door 103 is closed, it is possible to put the knob 12 in a position receding from the side surface portion 7*b* of the cover 7 inside the apparatus main body 101 by moving the knob 12. If the knob 12 widely projects from the side surface portion 7*b* of the cover 7 toward the door 103 when the door 103 is closed, it is necessary to keep a large gap between the door 103 and the cover 7 (fixing apparatus 111), and consequently the size of the apparatus main body 101 increases.

According to the structure of the fixing apparatus 111, there is a space for disposing the cover-fixing shaft 11 at an inner position of the apparatus main body, and it is possible to miniaturize the apparatus main body 101 by reducing the gap between the door 103 and the cover 7. Since the knob 12 is put in the position receding from the side surface portion 7*b* of the cover 7 by using the space held between the upper surface portion 7*a* of the cover 7 and the abutting member 9, there is no need to keep a special space for containing the knob 12.

When a recording medium P is jammed in the part above the contact portion between the heating roller 1 and the pressure roller 2 as shown in FIG. 2, the cover 7 is opened and the recording medium P is taken out from the case 4.

When the opening portion 5 of the case 4 is opened by the cover 7, the open portion 102 is opened by rotating the door 103 of the apparatus main body 101 outward as shown in FIG. 2. Thereby, a condition in which the door 103 is pushing the knob 12 is obviated. Therefore, the knob 12 is pushed by the compression coiled spring 13 and moved toward the proximal end portion of the cover-fixing shaft 11 along the axial direction of the cover-fixing shaft 11. The distal end portion of the knob 12 hits the head portion 22 of the cover-fixing shaft 11, and then the knob 12 stops. The knob 12 projects outward from the cover-fixing shaft 11 by moving toward the proximal end portion of the cover-fixing shaft 11. In other words, the knob 12 moves so as to advance from the space on the upper surface portion 7*a* of the cover 7, and projects from the side surface portion 7*b* of the cover 7 toward the outside of the apparatus main body 101.

As described above, the knob 12 automatically moves to a position where the operator can operate it by hand without being blocked by the cover 7.

The operator holds the knob 12 by hand, and rotates it in a direction of loosening the screw portion 21 of the cover-fixing shaft 11 around the axis. By rotating the knob 12, the cover-fixing shaft 11 is rotated together via the head portion 22. By rotation of the cover-fixing shaft 11, the screw portion 21 rotates in the tapped hole 24 of the receiver 6 of the case 4 in a loosening direction. The cover-fixing shaft 11 moves towards the outside of the apparatus main body 101 while rotating, and the screw portion 21 comes out from the tapped hole 24. Therefore, the cover 7 is released from fixation with the case 4. When the operator holds the knob 12 and pulls the cover-fixing shaft 11 toward the outside of the apparatus main body 101, the retaining ring 25 provided on the cover-fixing shaft 11 collides with the abutting member 9 of the cover 7 and prevents the cover-fixing shaft 11 from falling out from the hole 23 of the abutting member 9. The cover-fixing shaft 11 pulls the cover 7 toward the outside of the apparatus main body 101 via the retaining ring 25. As shown in FIG. 3, the cover 7 is pulled by the cover-fixing shaft 11 and swings toward the outside of the apparatus main body 101 with the fulcrum shaft 8 serving as a center. The cover 7 separates from the opening portion 5 of the case 4, and moves to the open position B. Thereby, the opening portion 5 of the case 4 is opened.

The plurality of strip bumps 28 are formed on the external surface portion of the knob 12. Therefore, when the operator holds the knob 12 by hand, the operator's hand touches the plurality of strip bumps 28, which reduces the area where the operator's hand contacts the knob 12.

The operator 4 inserts his (her) hands into the case 3 through the opened opening portion 5, and takes out the jammed recording medium P outside the case 3 through the opening portion 5.

Therefore, only by opening the door 103 of the apparatus main body 101, the knob 12 automatically projects, and the cover-fixing shaft 11 is prepared for being rotated, without operator's special operation. The operator can open the cover 7 by directly rotating the cover-fixing shaft 111, without using special tools. Therefore, the operation of opening the cover 7 is very easy and prompt in comparison with the case of opening the cover 7 by using special tools. Thus, when the recording medium P is jammed in the fixing apparatus, it is possible to easily and promptly perform an operation of opening the cover 7 to take out the jammed recording medium from the inside of the case.

When the cover 7 is to be closed, an operation converse to the operation of opening it is performed. Also the operation of closing the cover 7 can be easily performed without using special tools.

The present invention is not limited to the embodiment described above, but can be performed in various modifications. For example, the stopper, which limits the movement of the knob against force of the elastic member, is not limited to the door 103 provided on the apparatus main body 101, but another member may be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing device which fixes a toner image formed on the recording medium while conveying a recording medium;

a case which surrounds the fixing device and has an opening portion;

a cover provided on the case so as to open and close the opening portion of the case;

a cover-fixing shaft which is provided on the cover so as to be detachable to the case, part of the cover-fixing shaft projecting outside the cover;

a knob which is attached to the cover-fixing shaft, such that the knob is movable in an axial direction of the cover-fixing shaft and fixed in a rotational direction of an axis of the cover-fixing shaft;

an elastic member which is provided on the cover-fixing shaft and applies force to the knob in a direction away from the cover; and a stopper which prevents movement of the knob against force of the elastic member.

2. The fixing apparatus according to claim 1, wherein the fixing device heats and presses the toner image.

3. The fixing apparatus according to claim 1, wherein the cover has an upper surface portion and an abutting member standing upward from the upper surface portion, and a space for arranging the cover-fixing shaft is provided between the upper surface portion and the abutting member, the abutting member abutting against a receiver formed on an edge portion of the opening portion when the cover closes the opening portion.

4. The fixing apparatus according to claim 1, wherein the knob has a knurled portion on its external surface.

5. The fixing apparatus according to claim 1, wherein the knob is a separate component from the cover-fixing shaft.

6. An image forming apparatus comprising:

an apparatus main body having an open portion;

a door which is provided on the apparatus main body to open and close the open portion;

a photosensitive member which is provided inside the apparatus main body to form a toner image;

a transfer member which is provided inside the apparatus main body to transfer the toner image of the photosensitive body onto a recording medium; and a fixing apparatus which is provided inside the apparatus main body, facing the open portion, and fixes the toner image transferred onto the recording medium, the fixing apparatus further comprising:

a fixing device which fixes a toner image formed on the recording medium while conveying the recording medium;

a case which surrounds the fixing device and has an opening portion;

a cover provided on the case so as to open and close the opening portion of the case;

a cover-fixing shaft which is provided on the cover so as to be detachable to the case, a part of the cover-fixing shaft projecting outside the cover;

a knob which is attached to the cover-fixing shaft, such that the knob is movable in an axial direction of the cover-fixing shaft and fixed in a rotational direction of an axis of the cover-fixing shaft;

an elastic member which is provided on the cover-fixing shaft and applies force to the knob in a direction away from the cover; and a stopper which prevents movement of the knob against force of the elastic member.

7. The fixing apparatus according to claim 6, wherein the fixing device heats and presses the toner image.

8. The image forming apparatus according to claim 6, wherein the cover has a space for arranging the cover-fixing shaft at an inner position inside the apparatus main body, the inner position receding from the open portion of the apparatus main body.

9. The fixing apparatus according to claim 6, wherein the knob has a knurled portion on its external surface.

10. The image forming apparatus according to claim 6, wherein the knob is a separate component from the cover-fixing shaft.

11. An image forming apparatus comprising:

an apparatus main body having an open portion;

a door which closes the open portion;

a fixing apparatus which is stored in a case and provided inside the apparatus main body to face the open portion;

a cover which faces the open portion and covers an opening portion provided in the case;

a cover-fixing shaft which projects in a direction toward the door and is attached to an edge portion of the cover, and fixes the cover onto the case;

a knob which is attached to the cover-fixing shaft, wherein the knob moves along an axis of the cover-fixing shaft in the state where a rotation of the knob around the axis of the cover-fixing shaft is fixed; and an elastic member which urges the knob in a direction away from the cover along the cover-fixing shaft, wherein the knob abuts against an internal surface of the door, in the state where the door is closed, and is thereby pushed along the cover-fixing shaft in a compression direction of the elastic member, and wherein the knob is pushed by the elastic member and projects outside the apparatus main body from the open portion, in the state where the door is opened.

12. The image forming apparatus according to claim 11, wherein the knob is a separate component from the cover-fixing shaft.

* * * * *